US010195662B2

(12) United States Patent
Ownby et al.

(10) Patent No.: US 10,195,662 B2
(45) **Date of Patent: *Feb. 5, 2019**

(54) INSULATION ENCLOSURE INCORPORATING RIGID INSULATION MATERIALS

(71) Applicant: Halliburton Energy Services, Inc., Houston, TX (US)

(72) Inventors: Clayton A. Ownby, Houston, TX (US); Jeffrey G. Thomas, Magnolia, TX (US); Michael Clark, Tomball, TX (US); Ronald Joy, Katy, TX (US); Grant O. Cook, III, Spring, TX (US); Garrett T. Olsen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 492 days.

This patent is subject to a terminal disclaimer.

(21) Appl. No.: 14/440,457

(22) PCT Filed: Jun. 25, 2014

(86) PCT No.: PCT/US2014/043995
§ 371 (c)(1),
(2) Date: May 4, 2015

(87) PCT Pub. No.: WO2015/199668
PCT Pub. Date: Dec. 30, 2015

(65) Prior Publication Data

US 2017/0136535 A1 May 18, 2017

(51) Int. Cl.
*B22D 27/04* (2006.01)
*B22F 7/06* (2006.01)
(Continued)

(52) U.S. Cl.
CPC ..... *B22D 27/04* (2013.01); *B22D 19/14* (2013.01); *B22D 25/02* (2013.01); *B22F 3/003* (2013.01);
(Continued)

(58) Field of Classification Search
CPC ..... B22D 19/14; B22D 25/02; B22D 27/04; B22F 2005/001; B22F 3/003; B22F 7/06
(Continued)

(56) References Cited

U.S. PATENT DOCUMENTS 2,113,508 A 9/1936 Guinn
2,314,867 A 3/1943 Boynton
(Continued)

FOREIGN PATENT DOCUMENTS

CN 101288963 A 10/2008
CN 103555091 A 2/2014
(Continued)

OTHER PUBLICATIONS

Examination Report received in corresponding Australian Application No. 2013402479, dated Aug. 8, 2016.
(Continued)

*Primary Examiner* — Jessee R Roe
*Assistant Examiner* — Michael Aboagye
(74) *Attorney, Agent, or Firm* — Alan Bryson; Tumey L.L.P.

(57) ABSTRACT

An example insulation enclosure includes a support structure having a top end, a top wall provided at the top end, a bottom end, and an opening defined at the bottom end for receiving a mold within an interior of the support structure. Rigid insulation material may be supported by the support structure and extending between the top and bottom ends and across the top end. The rigid insulation material may extend between the top and bottom ends and consist of one
(Continued)

or more sidewall insulation loops that extend along a circumference of the insulation enclosure.

22 Claims, 6 Drawing Sheets

(51) Int. Cl.

| | |
|---|---|
| ***B22F 3/00*** | (2006.01) |
| ***B22D 19/14*** | (2006.01) |
| ***B22D 25/02*** | (2006.01) |
| *B22F 5/00* | (2006.01) |
| *C22C 1/10* | (2006.01) |

(52) U.S. Cl.
CPC ..... *B22F 7/06* (2013.01); *B22F 2005/001* (2013.01); *B22F 2999/00* (2013.01); *C22C 2001/1073* (2013.01)

(58) Field of Classification Search
USPC ..... 266/280; 168/338.1, 80, 123, 327; 76/108.1
See application file for complete search history.

(56) References Cited

U.S. PATENT DOCUMENTS

| | | | | |
|---|---|---|---|---|
| 3,037,797 | A | 6/1962 | Brown | |
| 3,248,764 | A * | 5/1966 | Chandley | B22D 27/045 148/100 |
| 3,376,915 | A | 4/1968 | Chandley | |
| 3,400,859 | A * | 9/1968 | Thakar | B22D 41/00 137/68.11 |
| 3,494,418 | A | 2/1970 | Young | |
| 3,532,155 | A * | 10/1970 | Anderson | B22D 27/045 164/122.1 |
| 3,810,504 | A * | 5/1974 | Piwonka | B22D 27/045 164/122.1 |
| 3,918,747 | A | 11/1975 | Putch | |
| 4,113,473 | A | 9/1978 | Gauvry et al. | |
| 4,281,858 | A | 8/1981 | Bowyer | |
| 4,409,451 | A * | 10/1983 | Taylor | B22D 27/045 164/507 |
| 4,411,455 | A | 10/1983 | Schnatzmeyer | |
| 4,609,029 | A * | 9/1986 | Vishnevsky | B22D 27/045 164/122.1 |
| 4,616,721 | A | 10/1986 | Furse | |
| 4,774,992 | A * | 10/1988 | George | B22D 27/045 164/122.1 |
| 4,898,151 | A | 2/1990 | Luebke et al. | |
| 5,207,274 | A | 5/1993 | Streich et al. | |
| 5,403,043 | A | 4/1995 | Smet | |
| 5,433,275 | A | 7/1995 | Melenyzer et al. | |
| 5,607,250 | A | 3/1997 | Tatterson et al. | |
| 5,848,646 | A | 12/1998 | Huber et al. | |
| 6,035,924 | A | 3/2000 | Graham | |
| 6,168,213 | B1 | 1/2001 | Muller | |
| 6,220,117 | B1 | 4/2001 | Butcher | |
| 6,460,900 | B1 | 10/2002 | Bakke | |
| 7,776,256 | B2 * | 8/2010 | Smith | B22F 7/062 419/10 |
| 8,496,064 | B2 | 7/2013 | Du et al. | |
| 8,505,638 | B2 | 8/2013 | Ezell et al. | |
| 2004/0149452 | A1 | 8/2004 | Pendleton | |
| 2005/0126775 | A1 | 6/2005 | Van Nguy et al. | |
| 2005/0155770 | A1 | 7/2005 | Parrott | |
| 2009/0056947 | A1 | 3/2009 | Du et al. | |
| 2009/0301682 | A1 | 12/2009 | Proske et al. | |
| 2010/0116487 | A1 | 5/2010 | Moyes | |
| 2010/0126734 | A1 | 5/2010 | Eriksen | |
| 2010/0126776 | A1 | 5/2010 | Trevino et al. | |
| 2011/0168406 | A1 | 7/2011 | Du et al. | |
| 2011/0180273 | A1 | 7/2011 | Hughes et al. | |
| 2012/0043046 | A1 * | 2/2012 | Bullied | C30B 11/00 164/338.1 |
| 2012/0168148 | A1 | 7/2012 | Avant et al. | |
| 2012/0234560 | A1 | 9/2012 | Ezell et al. | |
| 2015/0240571 | A1 | 8/2015 | Bowles | |

FOREIGN PATENT DOCUMENTS

| | | | |
|---|---|---|---|
| GB | 2343194 | A | 5/2000 |
| GB | 2364529 | A | 1/2002 |
| GB | 2404353 | A | 2/2005 |
| JP | 2006321684 | A | 11/2006 |
| JP | 2014008775 | A | 1/2014 |
| RU | 2260666 | C1 | 9/2005 |
| RU | 2358088 | C2 | 6/2009 |
| RU | 2372467 | C1 | 11/2009 |
| WO | 2015199668 | A1 | 12/2015 |

OTHER PUBLICATIONS

Extended European Search Report from European Patent Application No. 13895121.5, dated Feb. 24, 2017.
Chinese Office Action from Chinese Patent Application No. 201480077930.5, dated Jul. 11, 2017.
Russian Decision on Grant from Russian Patent Application No. 2016107699, dated May 11, 2017.
International Search Report and Written Opinion for PCT/US2014/043995 dated Mar. 25, 2015.
CA Office Action for Application No. 2,944,483 dated Jul. 27, 2018.

* cited by examiner

INSULATION ENCLOSURE INCORPORATING RIGID INSULATION MATERIALS

BACKGROUND

The present disclosure is related to oilfield tools and, more particularly, to an insulation enclosure that uses rigid insulation materials to help control the thermal profile of drill bits during manufacture.

Rotary drill bits are often used to drill oil and gas wells, geothermal wells, and water wells. One type of rotary drill bit is a fixed-cutter drill bit having a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body. The drilling fluids lubricate the cutting elements on the matrix drill bit.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement material within interior portions of the mold cavity. A preformed bit blank (or steel shank) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions, including both radially from a bit axis and axially parallel with the bit axis. Upon cooling, the infiltrated binder (e.g., metallic alloy) solidifies and incorporates the matrix reinforcement material to form a metal-matrix composite bit body and also binds the bit body to the bit blank to form the resulting matrix drill bit.

Typically, cooling begins at the periphery of the infiltrated matrix and continues inwardly, with the center of the bit body cooling at the slowest rate. Thus, even after the surfaces of the infiltrated matrix of the bit body have cooled, a pool of molten material may remain in the center of the bit body. As the molten material cools, there is a tendency for shrinkage that could result in voids forming within the bit body unless molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing or the lifespan of the drill bit may be dramatically reduced. If these defects are not detected and the drill bit is used in a job at a well site, the bit can fail and/or cause damage to the well including loss of rig time.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to oilfield tools and, more particularly, to an insulation enclosure that uses rigid insulation materials to help control the thermal profile of drill bits during manufacture.

Embodiments described herein include an insulation enclosure having, for example, a metallic support structure supporting rigid insulation materials, such as ceramics or fire bricks. As compared to insulating fabrics/blankets, such rigid insulation materials may be impervious to fluids and gases, such as steam that may be generated from the mold during cooling and, therefore, may be able to maintain the same insulative properties and capabilities for longer periods. As a result, the insulation materials may be selected based solely on insulating properties. In some cases, the insulation materials may be formed by vertically stacking individual sidewall insulation "loops" or "rings," each of which may have the horizontal cross-sectional shape of the enclosure (e.g., generally circular or generally rectangular) and may be supported by the support structure. The embodiments described herein may control the cooling process for molds, and the directional solidification of any molten contents within the molds may be optimized.

Figure 1:
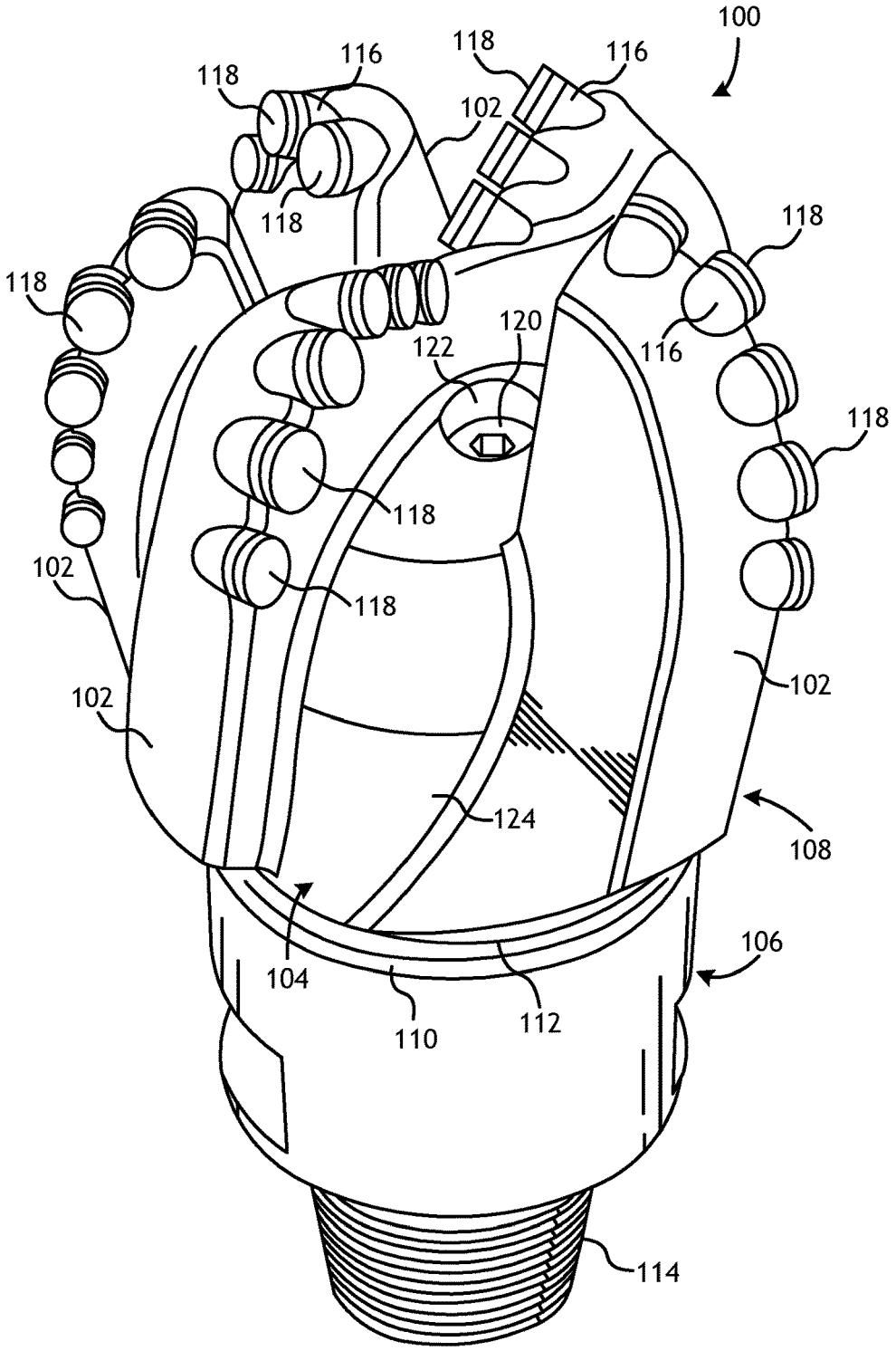
FIG. 1 illustrates an exemplary fixed-cutter drill bit that may be fabricated in accordance with the principles of the present disclosure.

FIG. 1 illustrates a perspective view of an example of a fixed-cutter drill bit 100 that may be fabricated in accordance with the principles of the present disclosure. As illustrated, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple pockets or recesses 116 (also referred to as "sockets" and/or "receptacles") are formed. Cutting elements 118, otherwise known as inserts, may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid (commonly referred to as "mud") can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Formed between each adjacent pair of cutter blades 102 are junk slots 124, along which cuttings, downhole debris, formation fluids, drilling fluid, etc., may pass and circulate back to the well surface within an annulus formed between exterior portions of the drill string and the interior of the wellbore being drilled (not expressly shown).

Figure 2A:
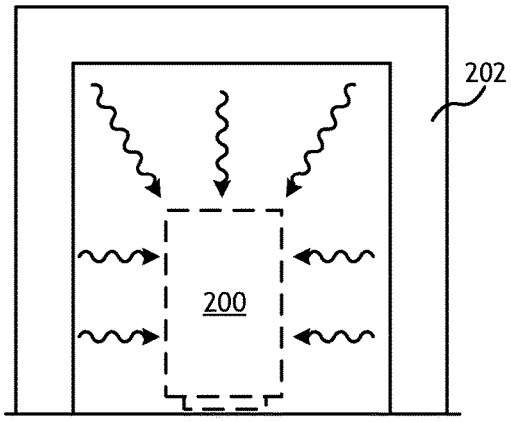
FIGS. 2A-2C illustrate progressive schematic diagrams of an exemplary method of fabricating a drill bit, in accordance with the principles of the present disclosure.
Figure 2B:
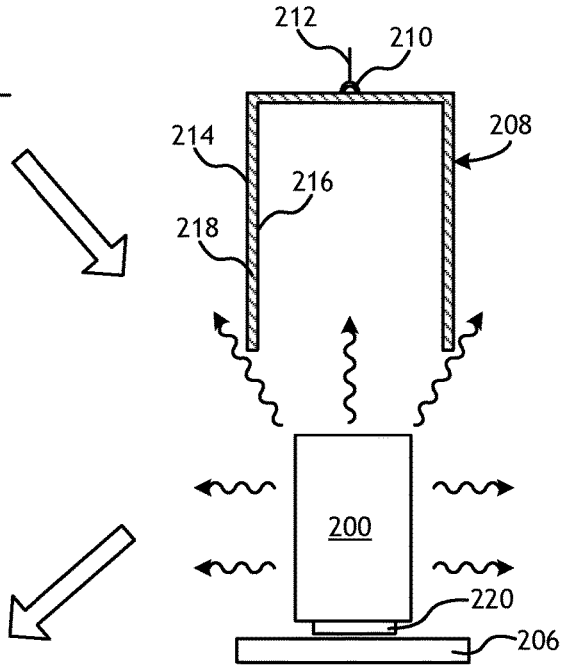
Figure 2C:
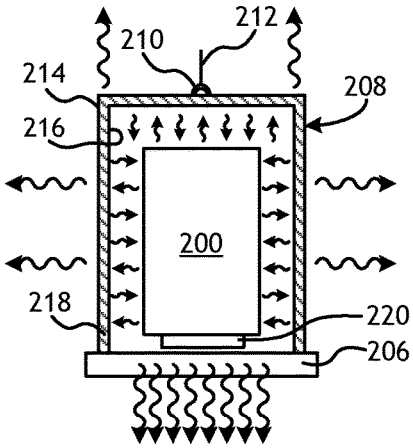

FIGS. 2A-2C are schematic diagrams that sequentially illustrate an example method of fabricating a drill bit, such as the drill bit 100 of FIG. 1, in accordance with the principles of the present disclosure. In FIG. 2A, a mold 200 is placed within a furnace 202. While not specifically depicted in FIGS. 2A-2C, the mold 200 may include and otherwise contain all the necessary materials and component parts required to produce a drill bit including, but not limited to, reinforcement materials, a binder material, displacement materials, a bit blank, etc.

For some applications, two or more different types of matrix reinforcement materials or powders may be positioned in the mold 200. Examples of such matrix reinforcement materials may include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used. Various binder (infiltration) materials that may be used include, but are not limited to, metallic alloys of copper (Cu), nickel (Ni), manganese (Mn), lead (Pb), tin (Sn), cobalt (Co) and silver (Ag). Phosphorous (P) may sometimes also be added in small quantities to reduce the melting temperature range of infiltration materials positioned in the mold 200. Various mixtures of such metallic alloys may also be used as the binder material.

The temperature of the mold 200 and its contents are elevated within the furnace 202 until the binder liquefies and is able to infiltrate the matrix material. Once a specified location in the mold 200 reaches a certain temperature in the furnace 202, or the mold 200 is otherwise maintained at a particular temperature within the furnace 202 for a predetermined amount of time, the mold 200 is then removed from the furnace 202. Upon being removed from the furnace 202, the mold 200 immediately begins to lose heat by radiating thermal energy to its surroundings while heat is also convected away by cold air from outside the furnace 202. In some cases, as depicted in FIG. 2B, the mold 200 may be transported to and set down upon a thermal heat sink 206. The radiative and convective heat losses from the mold 200 to the environment continue until an insulation enclosure 208 is lowered around the mold 200.

The insulation enclosure 208 may be a rigid shell or structure used to insulate the mold 200 and thereby slow the cooling process. In some cases, the insulation enclosure 208 may include a hook 210 attached to a top surface thereof. The hook 210 may provide an attachment location, such as for a lifting member, whereby the insulation enclosure 208 may be grasped and/or otherwise attached to for transport. For instance, a chain or wire 212 may be coupled to the hook 210 to lift and move the insulation enclosure 208, as illustrated. In other cases, a mandrel or other type of manipulator (not shown) may grasp onto the hook 210 to move the insulation enclosure 208 to a desired location.

In some embodiments, the insulation enclosure 208 may include an outer frame 214, an inner frame 216, and insulation material 218 positioned between the outer and inner frames 214, 216. In some embodiments, both the outer frame 214 and the inner frame 216 may be made of rolled steel and shaped (i.e., bent, welded, etc.) into the general shape, design, and/or configuration of the insulation enclosure 208. In other embodiments, the inner frame 216 may be a metal wire mesh that holds the insulation material 218 between the outer frame 214 and the inner frame 216. The insulation material 218 may be selected from a variety of insulative materials, such as those discussed below. In at least one embodiment, the insulation material 218 may be a ceramic fiber blanket, such as INSWOOL® or the like.

As depicted in FIG. 2C, the insulation enclosure 208 may enclose the mold 200 such that thermal energy radiating from the mold 200 is dramatically reduced from the top and sides of the mold 200 and is instead directed substantially downward and otherwise toward/into the thermal heat sink 206 or back towards the mold 200. In the illustrated embodiment, the thermal heat sink 206 is a cooling plate designed to circulate a fluid (e.g., water) at a reduced temperature relative to the mold 200 (i.e., at or near ambient) to draw thermal energy from the mold 200 and into the circulating fluid, and thereby reduce the temperature of the mold 200. In other embodiments, however, the thermal heat sink 206 may be any type of cooling device or heat exchanger configured to encourage heat transfer from the bottom 220 of the mold 200 to the thermal heat sink 206. In yet other embodiments, the thermal heat sink 206 may be any stable or rigid surface that may support the mold 200, and preferably having a high thermal capacity, such as a concrete slab or flooring.

Accordingly, once the insulation enclosure 208 is arranged about the mold 200 and the thermal heat sink 206 is operational, the majority of the thermal energy is transferred away from the mold 200 through the bottom 220 of the mold 200 and into the thermal heat sink 206. This controlled cooling of the mold 200 and its contents (i.e., the matrix drill bit) allows a user to regulate or control the thermal profile of the mold 200 to a certain extent and may result in directional solidification of the molten contents of the drill bit positioned within the mold 200, where axial solidification of the drill bit dominates its radial solidification. Within the mold 200, the face of the drill bit (i.e., the end of the drill bit that includes the cutters) may be positioned at the bottom 220 of the mold 200 and otherwise adjacent the thermal heat sink 206 while the shank 106 (FIG. 1) may be positioned adjacent the top of the mold 200. As a result, the drill bit may be cooled axially upward, from the cutters 118 (FIG. 1) toward the shank 106 (FIG. 1). Such directional solidification (from the bottom up) may prove advantageous in reducing the occurrence of voids due to shrinkage porosity, cracks at the interface between the bit blank and the molten materials, and nozzle cracks.

While FIG. 1 depicts a fixed-cutter drill bit 100 and FIGS. 2A-2C discuss the production of a generalized drill bit within the mold 200, the principles of the present disclosure are equally applicable to any type of oilfield drill bit or cutting tool including, but not limited to, fixed-angle drill bits, roller-cone drill bits, coring drill bits, bi-center drill bits, impregnated drill bits, reamers, stabilizers, hole openers, cutters, cutting elements, and the like. Moreover, it will be appreciated that the principles of the present disclosure may further apply to fabricating other types of tools and/or components formed, at least in part, through the use of molds. For example, the teachings of the present disclosure may also be applicable, but not limited to, non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, wash-over tools, rotors, stators and/or housings for downhole drilling motors, blades and housings for downhole turbines, and other downhole tools having complex configurations and/or asymmetric geometries associated with forming a wellbore.

During the cooling process of the mold 200, steam is often generated within the insulation enclosure 208. More particularly, steam may be generated at the interface between the thermal sink 206 and the mold 200 where water may migrate up through openings in the thermal sink (not shown) and come into direct contact with materials at elevated temperatures (e.g., the mold 200). If non-rigid insulation materials, such as an aluminum or silica insulation fabric blanket, were conventionally used, the steam may be absorbed by such insulation material. When it becomes moist, such insulation material would tend to undesirably transfer thermal energy at a much faster rate. Moreover, exposing such insulation material to steam may, over time, degrade the insulation material, which can adversely affect its insulative properties and/or capabilities.

The insulation material 218 of the present disclosure, by contrast, may comprise rigid and/or stackable insulation materials, which are more resilient to degradation by moisture (i.e., steam). As compared to insulating fabrics/blankets, such rigid insulation materials may be impervious to steam and, therefore, may be able to maintain the same insulative properties and capabilities for longer periods. As a result, the insulation material for the embodiments described herein may be selected based solely on insulating properties. Moreover, the embodiments described herein may facilitate a more controlled cooling process for the mold 200 and the directional solidification of the molten contents within the mold 200 (e.g., a drill bit) may be optimized. Through directional solidification, any potential defects (e.g., voids) may be formed at higher and/or more outward positions of the mold 200 where they can be machined off later during finishing operations.

Figure 3:
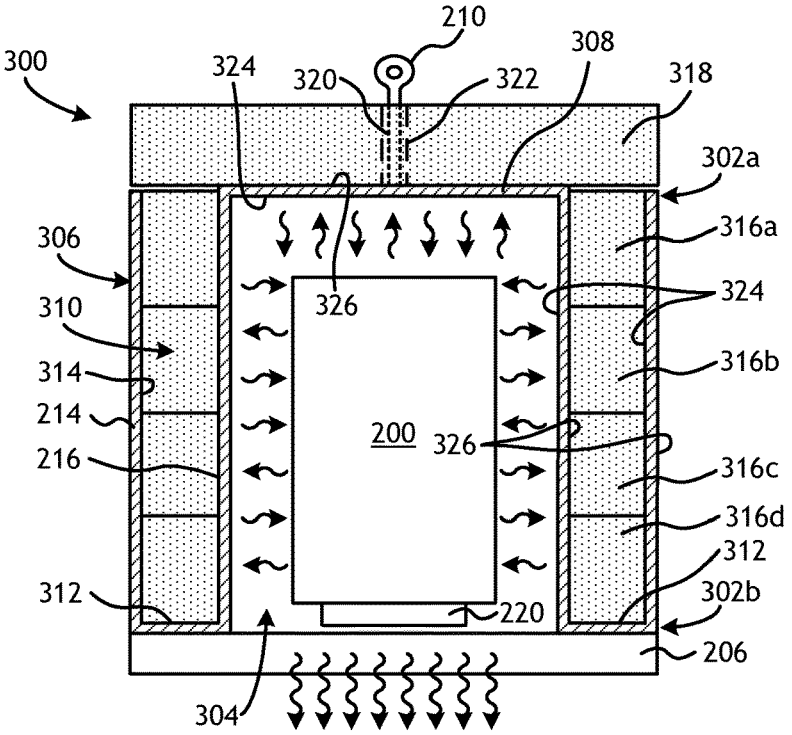
FIG. 3 illustrates a cross-sectional side view of an exemplary insulation enclosure, according to one or more embodiments.

FIG. 3 illustrates a cross-sectional side view of an exemplary insulation enclosure 300 set upon the thermal heat sink 206, according to one or more embodiments. The insulation enclosure 300 may be similar in some respects to the insulation enclosure 208 of FIGS. 2B and 2C and therefore may be best understood with reference thereto, where like numerals indicate like elements or components not described again.

The insulation enclosure 300 may include a support structure 306 that defines or otherwise provides the general shape and configuration of the insulation enclosure 300. In some embodiments, as illustrated, the support structure 306 may be an open-ended cylindrical structure having a top end 302*a* and bottom end 302*b*. The bottom end 302*b* may be open and otherwise define an opening 304 configured to receive the mold 200 within the interior of the support structure 306 as the insulation enclosure 300 is lowered around the mold 200. The top end 302*a* may be closed and otherwise provide a top wall 308. As illustrated, the hook 210 (in the form of an eyebolt or the like) may provide an attachment location at the top wall 308 so that an operator may manipulate the position of the insulation enclosure 300 during operation.

In some embodiments, as illustrated, the support structure 306 may include the outer wall 214 and the inner wall 216, as generally described above. The top wall 308 may extend between corresponding sidewall portions of the inner wall 216, as illustrated. In other embodiments, however, the top wall 308 may alternatively extend between corresponding sidewall portions of the outer wall 214, without departing from the scope of the disclosure. In one or more embodiments, as will be described below, one or both of the outer and inner walls 214, 216 may be omitted and the support structure 306 may instead be formed of only one of the outer and inner walls 214, 216 and the top wall 308, or solely the top wall 308, without departing from the scope of the present disclosure.

Figure 4:
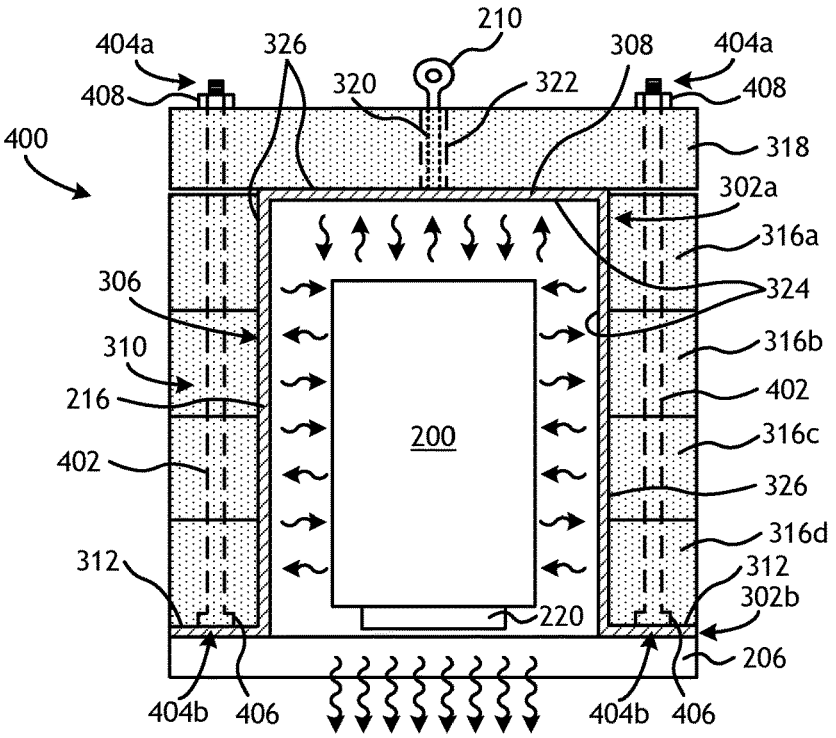
FIG. 4 illustrates a cross-sectional side view of another exemplary insulation enclosure, according to one or more embodiments.

In some embodiments, as illustrated, the support structure 306 may further include a footing 312 at the bottom end 302*b* of the insulation enclosure 300 that extends between the outer and inner walls 214, 216. In embodiments where the inner wall 216 is omitted, the footing 312 may instead extend from the outer wall 214. Similarly, in embodiments where the inner wall 216 is omitted, such as is shown in FIG. 4 below, the footing 312 may instead extend from the inner wall 216. In yet other embodiments, the footing 312 may be omitted altogether.

The support structure 306, may be made of any rigid material including, but not limited to, metals, ceramics (e.g., a molded ceramic substrate), composite materials, combinations thereof, and the like. In at least one embodiment, one or more components of the support structure 306 (i.e., the outer, inner, and top walls 214, 216, 308) may be made of a metal mesh. In the embodiment of FIG. 3, the support structure 306 has a generally circular shape, by way of example. However, the support structure may alternatively exhibit any suitable horizontal cross-sectional shape that will accommodate the general shape of the mold 200 including, but not limited to, circular, ovular, polygonal (e.g., square, rectangular, etc.), polygonal with rounded corners, or any hybrid thereof. In some embodiments, the support structure 306 may exhibit different horizontal cross-sectional shapes and/or sizes at different locations along the height of the insulation enclosure 300.

The insulation enclosure 300 may further include rigid insulation material 310 supported by the support structure 306 via various configurations of the insulation enclosure 300. The rigid insulation material 310 may generally extend between the top and bottom ends 302*a,b* of the support structure 306 and also across the top end 302*a*, thereby substantially surrounding or otherwise encapsulating the mold 200 within the rigid insulation material 310. For instance, as depicted in the illustrated embodiment, the outer and inner walls 214, 216 may cooperatively define a cavity 314, and the cavity 314 may be configured to receive and otherwise house a portion of the rigid insulation material 310. Moreover, another portion of the rigid insulation material 310 may also be supported atop the top wall 308.

The rigid insulation material 310 may include, but is not limited to, ceramics (e.g., oxides, carbides, borides, nitrides, and silicides that may be crystalline, non-crystalline, or semi-crystalline), polymers, insulating metal composites, molded carbons, nanocomposite molds, foams, any composite thereof, or any combination thereof. The rigid insulation material 310 may further include, but is not limited to, materials in the form of bricks, stones, blocks, cast shapes, molded shapes, foams, and the like, any hybrid thereof, or any combination thereof. Accordingly, examples of suitable materials that may be used as the rigid insulation material 310 may include, but are not limited to, ceramics, ceramic blocks, moldable ceramics, cast ceramics, firebricks, refractory bricks, graphite blocks, shaped graphite blocks, metal foams, metal castings, any composite thereof, or any combination thereof.

The rigid insulation material 310 positioned along the sidewalls of the insulation enclosure 300 may be made of a variety of vertically-stackable sidewall insulation loops 316 (shown as sidewall insulation loops 316*a*, 316*b*, 316*c*, and 316*d*). In some embodiments, each sidewall insulation loop 316*a-d* may include a plurality of individual insulation bricks or blocks arranged end-to-end along the perimeter of the insulation enclosure 300 within the cavity 314. Similar embodiments are shown in and discussed with reference to FIGS. 7A and 7B, as described below. Accordingly, in such embodiments, the individual insulation bricks or blocks of the sidewall insulation loops 316*a-d* may each cooperatively form respective rings that may be sequentially positioned and stacked atop one another within the cavity 314.

In other embodiments, however, each sidewall insulation loop 316*a-d* of the insulation enclosure 300 of FIG. 3 may form or provide a monolithic structure that may extend along the entire circumference of the insulation enclosure 300 within the cavity 314. For example, the fourth sidewall insulation loop 316*d* may be first placed within the cavity 314 and rested on the footing 312; the third sidewall insulation loop 316*c* may be placed above the fourth sidewall insulation loop 316*d*; the second sidewall insulation loop 316*b* may be positioned within the cavity 314 above the third sidewall insulation loop 316*c*; and the first sidewall insulation loop 316*a* may be positioned within the cavity 314 above the second sidewall insulation loop 316*b*.

While a vertical stack of four sidewall insulation loops 316*a-d* are depicted in FIG. 3, those skilled in the art will readily appreciate that fewer or greater than four sidewall insulation loops 316*a-d* may be employed in the insulation enclosure 300, without departing from the scope of the disclosure. In at least one embodiment, for instance, the four sidewall insulation loops 316*a-d* may be substituted with a single, continuous, monolithic, cylindrical sidewall insulation loop that extends along the entire circumference of the insulation enclosure 300 within the cavity 314 and also extends between the top and bottom ends 302*a,b* of the support structure 306.

The rigid insulation material 310 positioned across the top end 302*a* of the support structure 306 may be characterized as an insulation cap 318. In some embodiments, the insulation cap 318 may be composed of or otherwise include a plurality of individual insulation bricks or blocks (not shown) that are supported by the top wall 308. In other embodiments, as illustrated, the insulation cap 318 may be a monolithic ring or disc supported by (e.g., positioned atop) the top wall 308. In such embodiments, the hook 210 (in the form of an eyebolt or the like) may provide a shaft 320 that is extendable through a hole 322 defined through the insulation cap 318. The shaft 320 may be coupled to the top wall 308 via several attachment means including, but not limited to, threading, welding, one or more mechanical fasteners, and any combination thereof.

In some embodiments, a reflective coating 324 or material may be positioned on an inner surface of the support structure 306. More particularly, the reflective coating 324 may be adhered to and/or sprayed onto the inner surface of at least one of the outer, inner, and top walls 214, 216, 308 in order to reflect an amount of thermal energy emitted from the mold 200 back toward the mold 200. Furthermore, an insulative coating 326, such as a thermal barrier coating, may be applied to a surface of at least one of the outer, inner, and top walls 214, 216, 308. Such an insulative coating 326 could provide a thermal barrier between adjacent materials, such as the inner wall 216 and the rigid insulation material 310 or the rigid insulation material 310 and the outer wall 214. In other embodiments, or in addition thereto, the inner surface of at least one of the outer, inner, and top walls 214, 216, 308 may be polished to increase its emissivity.

As used herein, the term "perimeter" refers, consistent with the generally understood meaning in the art, to a continuous or substantially continuous line forming a boundary of a closed geometric figure. Depending on the context, the perimeter may be the linear distance along a sidewall insulation loop at a surface of a sidewall insulation loop, or the linear distance along a sidewall insulation loop at a fixed distance from a reference surface of a sidewall insulation loop. For example, since a sidewall insulation loop described herein may include an outer wall or an inner wall, the perimeter may refer to the continuous line forming a boundary at the outwardly facing surface of the outer wall, at the inwardly facing surface of the inner wall, or at a fixed distance from either the inwardly facing surface of the inner wall or the outwardly facing surface of the outer wall. Thus, the perimeter may be a circumference in the case of a sidewall insulation loop of circular cross-section, or a polygonal shape in the case of a sidewall insulation loop with a cross-section having a polygonal shape.

FIG. 4 illustrates a cross-sectional side view of another exemplary insulation enclosure 400, according to one or more embodiments. The insulation enclosure 400 may be similar in some respects to the insulation enclosure 300 of FIG. 3 and therefore may be best understood with reference thereto, where like numerals represent like elements not described again. Similar to the insulation enclosure 300 of FIG. 3, the insulation enclosure 400 may include the support structure 306 and the rigid insulation material 310 may be supported on or by the support structure 306.

Unlike the insulation enclosure 300 of FIG. 3, however, the outer wall 214 may be omitted from the support structure 306 of the insulation enclosure 400. In such embodiments, the sidewall insulation loops 316*a-d* (or a monolithic sidewall insulation loop that extends between the top and bottom ends 302*a,b*, as described above) may be supported on the support structure 306 via the footing 312. The insulation cap 318 may be positioned atop the sidewall insulation loops 316*a-d* and otherwise supported by the top wall 308.

In other embodiments, however, the footing 312 may be omitted from the insulation enclosure 400 and the sidewall insulation loops 316*a-d* may instead be supported by the support structure 306 via the top wall 308. More particularly, the insulation enclosure 400 may further include one or more support rods 402, each having a first end 404*a* and a second end 404*b*. The support rods 402 may be configured to extend longitudinally through corresponding holes (not labeled) drilled through or otherwise defined in the sidewall insulation loops 316*a-d* and the insulation cap 318. An enlarged radial shoulder 406 may be defined at the second end 404*b* of each support rod 402 and configured to engage an internal radial shoulder (not labeled) of a corresponding sidewall insulation loop 316*d*. Alternatively, the radial shoulder 406 may extend to span the bottom surface of the sidewall insulation loop 316*d*, such that a corresponding internal radial shoulder is not necessary.

Each support rod 402 may be extended through the sidewall insulation loops 316*a-d* (or a monolithic sidewall insulation loop that extends between the top and bottom ends 302*a,b*, as described above) until the radial shoulder 406 engages the internal radial shoulder of the fourth sidewall insulation loop 316*d*. The support rods 402 may also be extended through the insulation cap 318 and secured within the sidewall insulation loops 316*a-d* and the insulation cap 318 with a nut 408 threaded to the first end 404*a* on the exterior of the insulation cap 308. As will be appreciated, the nut 408 can be replaced with a different securing mechanism, such as a rod that extends through the support rods 402, a cotter pin, or the like. As the weight of the sidewall insulation loops 316*a-d* bears down on the support rods 402 (e.g., the radial shoulders 406), the support rods 402 bear down on the insulation cap 318, which is supported by the top wall 308. Accordingly, the sidewall insulation loops 316*a-d* may be supported via the top wall 308, which may extend radially outward (not shown), with or without the footing 312.

In yet other embodiments, the support rods 402 may be omitted and the sidewall insulation loops 316*a-d* (or a monolithic sidewall insulation loop that extends between the top and bottom ends 302*a,b*) may each be coupled or otherwise fastened to the inner wall 216 using one or more mechanical fasteners (not shown), such as bolts, screws, pins, etc. In some embodiments, the reflective coating 324 may be positioned on an inner surface of the support structure 306, such as on the inner surface of at least one of the inner and top walls 216, 308. Moreover, the insulative coating 326 (e.g., a thermal barrier coating) may be applied to an outer or inner surface of at least one of the inner and top walls 216, 308.

Figure 5:
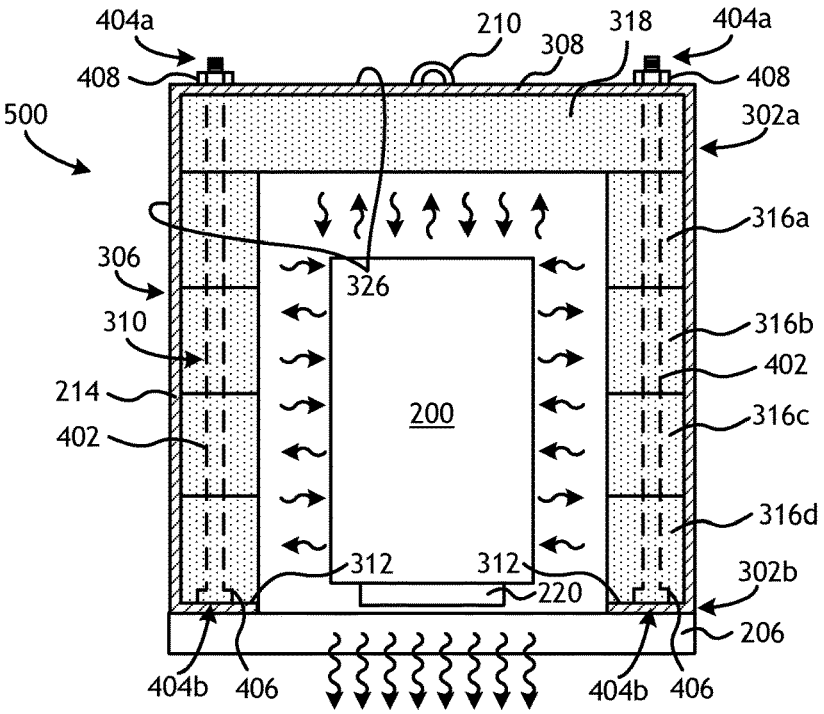
FIG. 5 illustrates a cross-sectional side view of another exemplary insulation enclosure, according to one or more embodiments.

FIG. 5 illustrates a cross-sectional side view of another exemplary insulation enclosure 500, according to one or more embodiments. The insulation enclosure 500 may be similar in some respects to the insulation enclosures 300 and 400 of FIGS. 3 and 4, respectively, and therefore may be best understood with reference thereto, where like numerals represent like elements not described again. Similar to the insulation enclosures 300 and 400, the insulation enclosure 500 may include the support structure 306 and the rigid insulation material 310 supported on the support structure 306.

Unlike the insulation enclosures 300 and 400, however, the inner wall 216 may be omitted from the support structure 306 of the insulation enclosure 500. In such embodiments, the sidewall insulation loops 316*a-d* may be generally supported on the support structure 306 via the footing 312, and the insulation cap 318 may be positioned atop the sidewall insulation loops 316*a-d*.

In other embodiments, however, the footing 312 may be omitted from the insulation enclosure 500 and the sidewall insulation loops 316*a-d* may instead be supported on the support structure 306 via the top wall 308. More particularly, the insulation enclosure 500 may further include the support rods 402 that extend longitudinally through corresponding holes defined in the sidewall insulation loops 316*a-d* and the insulation cap 318, and also corresponding holes (not shown) defined in the top wall 308. The enlarged radial shoulder 406 defined at the second end 404*b* of each support rod 402 may engage the internal radial shoulder (not labeled) of the corresponding sidewall insulation loop 316*d*. Each support rod 402 may be extended through the sidewall insulation loops 316*a-d*, the insulation cap 318, and the top wall 308, and the support rods 402 may be secured within the insulation enclosure 500 with the nuts 408 threaded to the first end 404*a* on the exterior of the top wall 308. As the weight of the sidewall insulation loops 316*a-d* and the insulation cap 318 bear down on the support rods 402 (e.g., the radial shoulders 406), the support rods 402, in turn, bear down on the top wall 308 as coupled thereto with the nuts 408. Accordingly, the sidewall insulation loops 316*a-d* and the insulation cap 318 may be effectively hung off the top wall 308 through interaction with the support rods 402.

In yet other embodiments, the support rods 402 may be omitted and the sidewall insulation loops 316*a-d* (or a monolithic sidewall insulation loop that extends between the top and bottom ends 302*a,b*) may instead be coupled or otherwise fastened to the outer wall 214 using one or more mechanical fasteners (not shown), such as bolts, screws, pins, etc. In some embodiments, the insulative coating 326 (e.g., a thermal barrier coating) may be applied to an outer or inner surface of at least one of the outer and top walls 214, 308.

Figure 6:
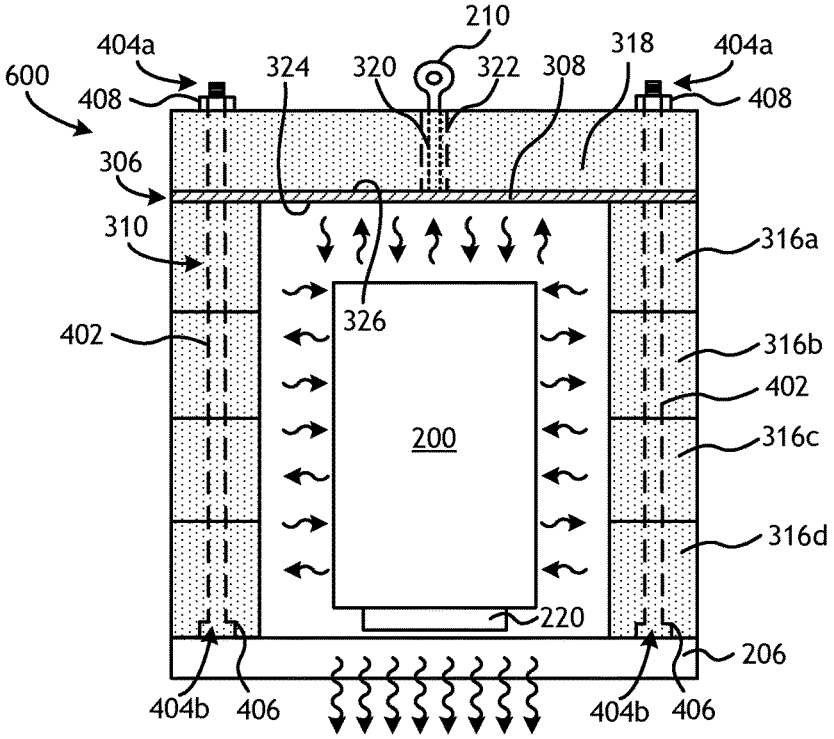
FIG. 6 illustrates a cross-sectional side view of another exemplary insulation enclosure, according to one or more embodiments.

FIG. 6 illustrates a cross-sectional side view of another exemplary insulation enclosure 600, according to one or more embodiments. The insulation enclosure 600 may be similar in some respects to the insulation enclosures 300, 400, 500 of FIGS. 3-5, respectively, and therefore may be best understood with reference thereto, where like numerals represent like elements not described again. Similar to the insulation enclosures 300, 400, 500, the insulation enclosure 600 may include the support structure 306 and the rigid insulation material 310 may be supported on the support structure 306.

Unlike the insulation enclosures 300, 400, 500, however, the support structure 306 of the insulation enclosure 600 may include only the top wall 308, and the sidewall insulation loops 316*a-d* and the insulation cap 318 may all be supported via interaction with the top wall 308. More particularly, the insulation enclosure 600 may include the support rods 402 that extend longitudinally through corresponding holes defined in the sidewall insulation loops 316*a-d* and the insulation cap 318, and also corresponding holes defined in the top wall 308. The enlarged radial shoulder 406 defined at the second end 404*b* of each support rod 402 may engage the internal radial shoulder (not labeled) of the corresponding sidewall insulation loop 316*d*. Each support rod 402 may be extended through the sidewall insulation loops 316*a-d*, the top wall 308, and the insulation cap 318 and secured within the insulation enclosure 600 with the nuts 408 threaded to the first end 404*a* on the exterior of the insulation cap 318. As the weight of the sidewall insulation loops 316*a-d* bears down on the support rods 402, the support rods 402 bear down on the insulation cap 318, which is supported by the top wall 308. The hook 210 (in the form of an eyebolt or the like) may be attached to the top wall 308 at the shaft 320 as extended through the hole 322 defined through the insulation cap 318.

In some embodiments, the reflective coating 324 may be positioned on an inner surface of the support structure 306, such as the inner surface of the top wall 308. Moreover, the insulative coating 326 (e.g., a thermal barrier coating) may be applied to an outer or inner surface of the top wall 308, without departing from the scope of the disclosure.

While the insulation enclosures 300, 400, 500, and 600 are described herein as including particular configurations of the support structure 306 and the rigid insulation material 310, those skilled in the art will readily appreciate that variations of the insulation enclosures 300, 400, 500, and 600 are equally possible, without departing from the scope of the disclosure. For example, it will further be appreciated that the embodiments disclosed in all of FIGS. 3-6 may be combined in any combination, in keeping within the scope of this disclosure.

Moreover, in some embodiments, the insulation enclosures 300, 400, 500, and 600 described herein may be preheated. More specifically, radiant heat flux from the mold 200 once removed from the furnace 202 (FIG. 2A) is proportional to the difference in the temperature of the mold 200 raised to the fourth power and the temperature of its immediate surroundings raised to the fourth power (temperature measured in an absolute scale, such as Kelvin). For example, a mold 200 may exit the furnace 202 at a temperature in the 1800° F. to 2500° F. range (1255K to 1644K) and immediately radiate thermal energy at a high rate to the room-temperature surroundings (approximately 293K). Moreover, once an insulation enclosure (e.g., the insulation enclosures 300, 400, 500, and 600) is lowered over the mold 200, thermal energy continues to radiate from the mold 200 at a high rate, causing significant heat losses until the temperature of the insulation enclosure is elevated to at or near the temperature of the mold 200. Accordingly, an insulation enclosure may be preheated so that the radiative heat losses from the mold 200 may be slowed.

In some embodiments, for instance, the insulation enclosures 300, 400, 500, and 600 described herein may be preheated within the furnace 202 (FIG. 2A) or another furnace. In other embodiments, the insulation enclosures 300, 400, 500, and 600 may be preheated using one or more thermal elements embedded within the rigid insulation material 310 or otherwise positioned about the outer or inner periphery of the insulation enclosures 300, 400, 500, and 600. By preheating the insulation enclosures 300, 400, 500, and 600, the rigid insulation material may act as a thermal mass in addition to providing insulation resistance. As a result, once placed over the mold 200, the preheated insulation enclosures 300, 400, 500, and 600 slow the cooling process, while the thermal heat sink 206 constantly cools from the bottom 220 of the mold 200.

Figure 7A:
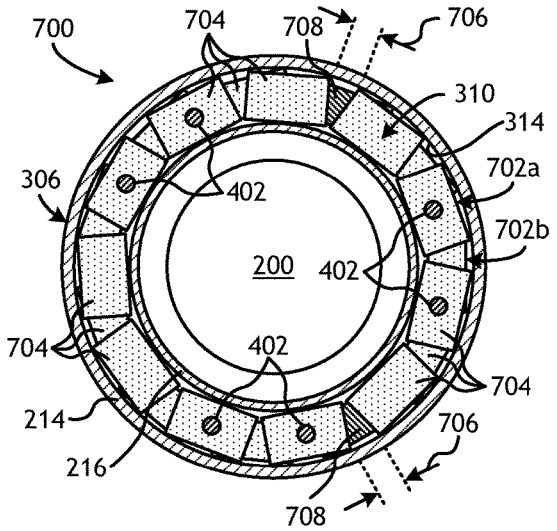
FIG. 7A illustrates a cross-sectional top view of an exemplary insulation enclosure, according to one or more embodiments.
Figure 7B:
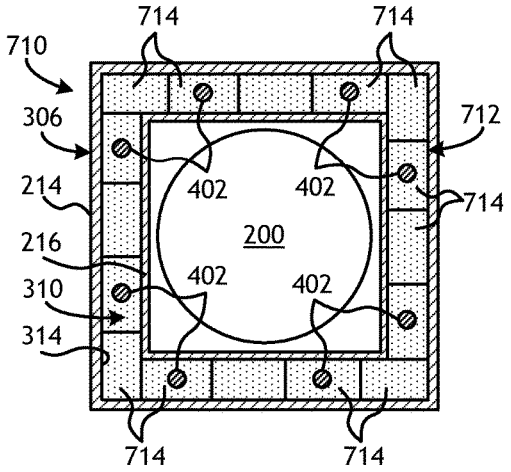
FIG. 7B illustrates a cross-sectional top view of another exemplary insulation enclosure, according to one or more embodiments.

FIGS. 7A and 7B illustrate cross-sectional top views of exemplary insulation enclosures, according to one or more embodiments. The cross-sectional views are taken at a location between the top and bottom ends 302*a,b* (FIGS. 3-6) of the support structure 306. Each insulation enclosure depicted in FIGS. 7A and 7B may be similar to (or the same as) one of the insulation enclosures 300, 400, 500, and 600 of FIGS. 3-6, respectively, and therefore may be best understood with reference thereto, where like numerals will indicate like elements not described again. In the embodiments of FIGS. 7A and 7B, the mold 200 is depicted as exhibiting a substantially circular cross-section. Those skilled in the art will readily appreciate, however, that the mold 200 may alternatively exhibit other cross-sectional shapes including, but not limited to, ovular, polygonal, polygonal with rounded corners, or any hybrid thereof.

In FIG. 7A, an exemplary insulation enclosure 700 is depicted as exhibiting a substantially circular horizontal cross-sectional shape. More particularly, the insulation enclosure 700 may include a substantially circular support structure 306 including both the outer and inner walls 214, 216. In other embodiments, however, as described above, one or both of the outer and inner walls 214, 216 may be omitted from the insulation enclosure 700, without departing from the scope of the disclosure. Moreover, as will be appreciated, in other embodiments, the insulation enclosure 700 may alternatively exhibit a generally ovular or polygonal horizontal cross-sectional shape in order to accommodate the mold 200.

The rigid insulation material 310 is depicted as being positioned within the cavity 314 defined between the outer and inner walls 214, 216. As illustrated, the rigid insulation material 310 consists of a plurality of sidewall insulation loops 702 (shown as first and second sidewall insulation loops 702*a* and 702*b*). The first sidewall insulation loop 702*a* is depicted as being positioned atop the second sidewall insulation loop 702*b*, and each sidewall insulation loop 702*a,b* includes a plurality of individual insulation bricks or blocks 704 that cooperatively extend along a circumference of the insulation enclosure 700 within the cavity 314. While only two sidewall insulation loops 702*a,b* are depicted in FIG. 7A, it will be appreciated that more than two sidewall insulation loops 702*a,b* may be employed in the insulation enclosure 700, without departing from the scope of the disclosure.

Sectioning the first and second sidewall insulation loops 702*a,b* into individual insulation blocks 704 of rigid insulation material 310 may prove advantageous in providing expansion joints to minimize thermal shock or thermal fatigue cracking of the rigid insulation material 310. In some embodiments, any remaining gaps 706 between adjacent insulation blocks 704 of the insulation material 310 may be filled with a thermal shock-resistant filler 708, such as moldable ceramic putty or caulk. As will be appreciated, the configuration of the first and second sidewall insulation loops 702*a,b* is only one potential configuration or design. Other configurations may be consistent with known bricklaying techniques configured to modify or otherwise optimize the design and operation of the insulation enclosure 700. For instance, the insulation blocks 704 may alternatively be machined or formed to have a trapezoidal shape, such that the triangular gaps illustrated in FIG. 7A become planar gaps and otherwise enabling intimate, planar contact between adjacent insulation blocks 704.

Moreover, while the first and second sidewall insulation loops 702*a,b* are depicted as including a plurality of individual insulation blocks 704, each sidewall insulation loop 702*a,b* may alternatively be comprised of a monolithic ring or annulus stacked atop one another within the cavity 314. In other embodiments, the first and second sidewall insulation loops 702*a,b*, and any other sidewall insulation loops of the insulation enclosure 700, may further be combined into a single, monolithic, cylindrical sidewall insulation loop (not shown). Such a single, monolithic, cylindrical sidewall insulation loop may be configured to extend along the entire circumference of the insulation enclosure 700 within the cavity 314 and also extend between the top and bottom ends 302*a,b* (FIGS. 3-6) of the support structure 306.

In some embodiments, the insulation enclosure 700 may further include one or more support rods 402 configured to extend longitudinally through corresponding holes (not labeled) drilled through or otherwise defined in the first and second sidewall insulation loops 702*a,b*. While only six support rods 402 are depicted in FIG. 7A as used in conjunction with corresponding insulation blocks 704, those skilled in the art will readily appreciate that each insulation block 704 may have a support rod 402 extended therethrough, without departing from the scope of the disclosure.

In FIG. 7B, another exemplary insulation enclosure 710 is depicted as exhibiting a substantially square cross-sectional shape. More particularly, the insulation enclosure 710 may include a substantially square support structure 306 that includes both the outer and inner walls 214, 216. In other embodiments, as described above, one or both of the outer and inner walls 214, 216 may be omitted from the insulation enclosure 710, without departing from the scope of the disclosure. Moreover, as will be appreciated, in other embodiments, the insulation enclosure 710 may alternatively exhibit any other polygonal horizontal cross-sectional shape to accommodate different shapes and sizes of the mold 200.

The rigid insulation material 310 is depicted as being positioned within the cavity 314 defined between the outer and inner walls 214, 216. As illustrated, the rigid insulation material 310 forms a sidewall insulation loop 712 that includes a plurality of individual insulation bricks or blocks 714 placed adjacent one another to form a square-shaped ring or loop. The insulation blocks 714 may be similar to the insulation blocks 704 of the insulation enclosure 700 of FIG. 7A. Any remaining gaps (not shown) between adjacent insulation blocks 714 of the insulation material 310 may be filled with a thermal-shock-resistant filler (not shown), such as moldable ceramic putty or caulk. As will be appreciated, while the insulation blocks 714 are arranged in a particular configuration or design in the square-shaped sidewall insulation loop 712, other configurations or designs may be consistent with known bricklaying techniques configured to modify or otherwise optimize the design and operation of the insulation enclosure 710.

The sidewall insulation loop 712 may be one of several sidewall insulation loops that extend between the top and bottom ends 302*a,b* (FIGS. 3-6) of the support structure 306. Moreover, while the rigid insulation material 310 is depicted as a plurality of insulation blocks 714, the sidewall insulation loop 712 may alternatively be a monolithic ring or annulus made of a formed or pressed ceramic material, for example. Such a monolithic sidewall insulation loop may be stacked among one or more other sidewall insulation loops (not shown) within the cavity 314. In other embodiments, such a monolithic sidewall insulation loop may extend along the entire circumference of the insulation enclosure 710 within the cavity 314 and also extend longitudinally between the top and bottom ends 302*a,b* (FIGS. 3-6) of the support structure 306, without departing from the scope of the disclosure.

In some embodiments, the insulation enclosure 710 may further include one or more support rods 402 configured to extend longitudinally through corresponding holes (not labeled) drilled through or otherwise defined in the sidewall insulation loop 712, such as in one or more of the insulation blocks 714. While only eight support rods 402 are depicted in FIG. 7B as used in conjunction with corresponding insulation blocks 714, those skilled in the art will readily appreciate that each insulation block 714 may have a support rod 402 extended therethrough to help support the sidewall insulation loop 712, without departing from the scope of the disclosure.

Figure 8A:
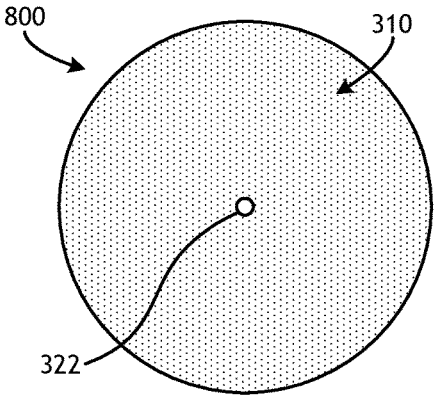
FIG. 8A illustrates a top view of an exemplary insulation cap, according to one or more embodiments.
Figure 8B:
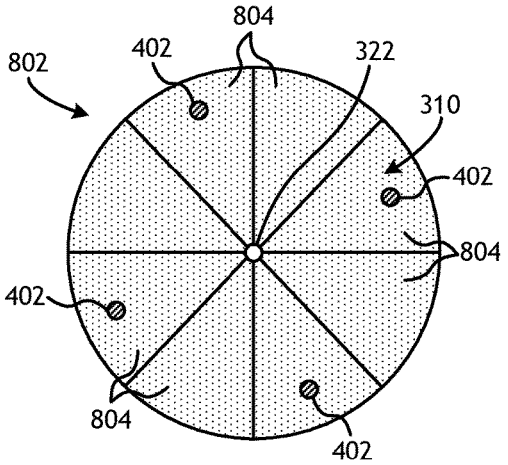
FIG. 8B illustrates a top view of another exemplary insulation cap, according to one or more embodiments.

FIGS. 8A and 8B illustrate top views of exemplary insulation caps 800 and 802, respectively, according to one or more embodiments. The insulation caps 800, 802 may be the same as or similar to any of the insulation caps 318 described above with reference to FIGS. 3-6. Accordingly, the insulation caps 800, 802 may include a portion of the rigid insulation material 310 and may be supported by the top wall 308 (FIGS. 3-6) either above or below the top wall 308. While the insulation caps 800, 802 are depicted as exhibiting a generally circular shape, those skilled in the art will readily appreciate that the insulation caps 800, 802 may alternatively exhibit other shapes such as, but not limited to, ovular, polygonal (e.g., square, rectangular, etc.), polygonal with rounded corners, or any hybrid thereof.

In FIG. 8A, the insulation cap 800 is depicted as a monolithic disc or ring composed of the insulation material 310. In some embodiments, the hole 322 may be centrally defined in the insulation cap 800 and configured to receive the shaft 320 (FIGS. 3, 4, and 6) of the hook 210 (FIGS. 3, 4, and 6) so that the hook 210 may be coupled to the top wall 308 (FIGS. 3, 4, and 6) to manipulate the position of the corresponding insulation enclosure. In other embodiments, such as embodiments where the insulation cap 800 is positioned below the top wall 308, the hole 322 may be omitted and the hook 210 may instead be coupled directly to the top wall 308 without having to penetrate the insulation cap 800.

In FIG. 8B, the insulation cap 802 is depicted as being composed of or otherwise including a plurality of individual insulation bricks or blocks 804. As illustrated, the hole 322 may again be centrally defined in the insulation cap 802, but may alternatively be omitted in embodiments where the insulation cap 802 is positioned below the top wall 308 (FIGS. 3, 4, and 6). The insulation blocks 804 are depicted in FIG. 8B as triangular, pie-shaped blocks or bricks. In other embodiments, however, the insulation blocks 804 may exhibit other shapes, such as polygonal (e.g., square, rectangular, triangular, etc.), without departing from the scope of the disclosure. Moreover, the insulation blocks 804 may be positioned and otherwise aligned such that any gaps between adjacent insulation blocks 804 are minimized or eliminated altogether. Any remaining gaps between adjacent insulation blocks 804 may be filled with a thermal-shock-resistant filler, such as moldable ceramic putty or caulk.

Moreover, in some embodiments, the insulation cap 802 may further include one or more support rods 402 configured to extend longitudinally through corresponding holes (not labeled) drilled through or otherwise defined in the insulation blocks 804. While only four support rods 402 are depicted in FIG. 8B as used in conjunction with corresponding insulation blocks 804, those skilled in the art will readily appreciate that each insulation block 804 may have a support rod 402 extended therethrough, without departing from the scope of the disclosure.

Figure 9A:
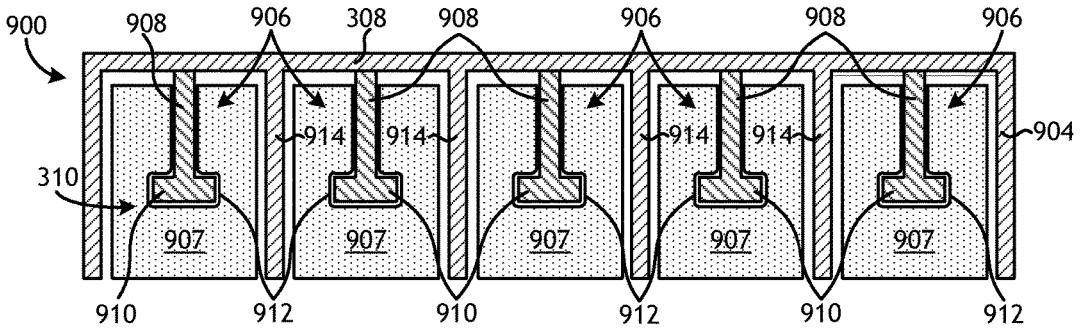
FIG. 9A illustrates a cross-sectional side view of an exemplary insulation cap, according to one or more embodiments.
Figure 9B:
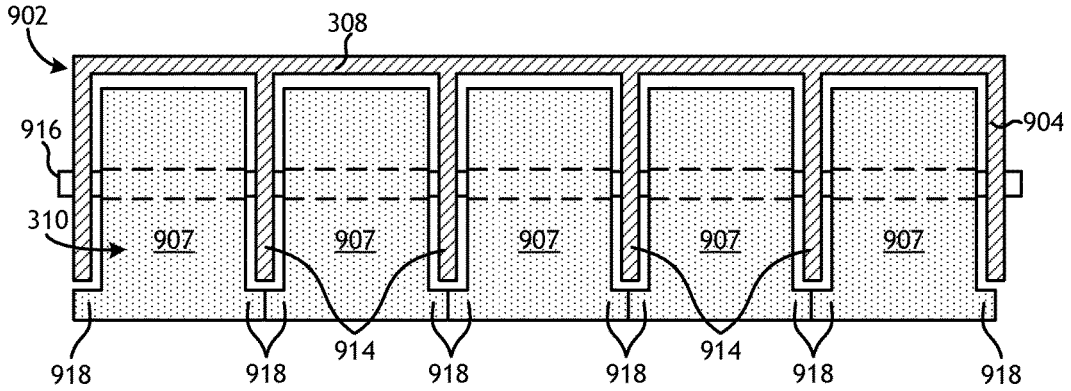
FIG. 9B illustrates a cross-sectional side view of another exemplary insulation cap, according to one or more embodiments.

FIGS. 9A and 9B illustrate cross-sectional side views of two exemplary insulation caps 900 and 902, respectively, according to one or more embodiments. The insulation caps 900, 902 may be the same as or similar to any of the insulation caps described herein. Accordingly, the insulation caps 900, 902 may include rigid insulation material 310 and may be supported by the top wall 308. In some embodiments, the insulation caps 900, 902 may be substantially square when viewed from the top. In other embodiments, however, the insulation caps 900, 902 may alternatively exhibit any other shape when viewed from the top including, but not limited to, circular, ovular, polygonal, polygonal with rounded corners, or any hybrid thereof.

As illustrated, each insulation cap 900, 902 may be supported beneath the top wall 308 in different configurations. In some embodiments, the top wall 308 may include or otherwise provide one or more end walls 904. The end wall(s) 904 may be configured to substantially enclose the rigid insulation material 310 within the corresponding insulation cap 900, 902 on lateral ends or sides thereof. Moreover, in some embodiments, the end walls 904 may be used to couple the insulation cap to the remaining portions of the given insulation enclosure.

In FIG. 9A, the insulation cap 900 may include one or more support hangers 906 configured to secure a plurality of insulation blocks 907 to the insulation cap 900. In some embodiments, as illustrated, each support hanger 906 may include a stem 908 and a T-shaped head 910 positioned at the distal end of the stem 908. The stem 908 may be coupled to the inner surface of the top wall and extend substantially downward therefrom. Each insulation block 907 may define a corresponding T-shaped groove 912 configured to receive a corresponding support hanger 906. It will be appreciated that more than one insulation block 907 may be hung off a single support hanger 906, without departing from the scope of the disclosure. Moreover, it will further be appreciated that other designs for the support hangers 906 may also be employed in keeping with the scope of the disclosure.

In some embodiments, laterally adjacent insulation blocks 907 may be separated by a separator wall 914 extending from the inner surface of the top wall 308. In other embodiments, the separator walls 914 may be omitted from the insulation cap 900 and any remaining gaps between adjacent insulation blocks 907 may be left unfilled or filled with a thermal-shock-resistant filler, such as moldable ceramic putty or caulk. While a certain number and size of insulation blocks 907 are depicted in FIG. 9A as separated by the separator walls 914, it will be appreciated that any number of insulation blocks 907 may be included in the insulation cap 900, without departing from the scope of the disclosure.

In FIG. 9B, the insulation cap 902 may include one or more support pins 916 configured to extend laterally (e.g., horizontally or otherwise parallel to the top wall 308) through the insulation cap 902 to secure the plurality of insulation blocks 907 to the insulation cap 902. More particularly, the support pin(s) 916 may extend laterally through the end wall(s) 904, one or more of the insulation blocks 907, and the separator walls 914 (if used) to suspend or secure the insulation blocks 907 to the insulation cap 902. The support pin(s) 916 may be made of any rigid material including, but not limited to, metals, ceramics, composite materials, combinations thereof, and the like. Again, while a certain number and size of insulation blocks 907 are depicted in FIG. 9B as separated by the separator walls 914, it will be appreciated that any number of insulation blocks 907 may be included in the insulation cap 902, without departing from the scope of the disclosure.

In some embodiments, as illustrated, one or more of the insulation blocks 907 may include a radial shoulder 918 defined at its base. The radial shoulders 918 may be machined or otherwise formed into each insulation block 907. Each radial shoulder 918 may be configured to extend laterally a short distance until coming into contact with or close to an adjacent radial shoulder 918 of an adjacent insulation block 907. As will be appreciated, such a configuration may prove advantageous in minimizing gaps between adjacent insulation blocks 907, which may help to insulate the optional separator walls 914 from thermal radiation.

Embodiments disclosed herein include:

A. An insulation enclosure that includes a support structure having a top end, a top wall provided at the top end, a bottom end, and an opening defined at the bottom end for receiving a mold within an interior of the support structure, and rigid insulation material supported by the support structure and extending between the top and bottom ends and across the top end, wherein the rigid insulation material extending between the top and bottom ends consists of one or more sidewall insulation loops that extend along a circumference of the insulation enclosure.

B. A method that includes removing a mold from a furnace, the mold having a top and a bottom, placing the mold on a thermal heat sink with the bottom adjacent the thermal heat sink, lowering an insulation enclosure around the mold, the insulation enclosure including a support structure having a top end, a top wall provided at the top end, a bottom end, and an opening defined at the bottom end for receiving the mold within the support structure, the insulation enclosure further including rigid insulation material supported by the support structure and extending between the top and bottom ends and across the top end, wherein the rigid insulation material extending between the top and bottom ends consists of one or more sidewall insulation loops that extend along a circumference of the insulation enclosure, and cooling the mold axially upward from the bottom to the top.

Each of embodiments A and B may have one or more of the following additional elements in any combination: Element 1: wherein the support structure further includes at least one of an outer wall and an inner wall, and the top wall extends between either the outer wall or the inner wall. Element 2: wherein a cavity is defined between the outer and inner walls and the one or more sidewall insulation loops are positioned within the cavity. Element 3: wherein the support structure further provides a footing at the bottom end that extends from one or both of the outer and inner walls, and wherein the one or more sidewall insulation loops are at least partially supported by the footing. Element 4: wherein the rigid insulation material is a material selected from the group consisting of ceramics, ceramic blocks, moldable ceramics, cast ceramics, fire bricks, refractory bricks, graphite blocks, shaped graphite blocks, metal foams, metal castings, any composite thereof, and any combination thereof. Element 5: wherein at least one of the one or more sidewall insulation loops comprises a plurality of insulation blocks that cooperatively extend along the circumference of the insulation enclosure. Element 6: wherein a gap defined between adjacent insulation blocks of the plurality of insulation blocks is filled with a thermal-shock-resistant filler. Element 7: further comprising one or more support rods that extend through the one or more sidewall insulation loops, wherein the one or more sidewall insulation loops are supported by the top wall via the one or more support rods. Element 8: wherein the one or more support rods further extend through at least one of the top wall and the rigid insulation material extending across the top end. Element 9: wherein the rigid insulation material extending across the top end is an insulation cap comprising a monolithic disc supported by the top wall. Element 10: wherein the rigid insulation material extending across the top end is an insulation cap comprising a plurality of insulation blocks supported by the top wall. Element 11: wherein a gap defined between adjacent insulation blocks of the plurality of insulation blocks is filled with a thermal shock-resistant filler. Element 12: further comprising one or more support hangers extending from an inner surface of the top wall to secure the plurality of insulation blocks to the insulation cap. Element 13: further comprising one or more support pins extending laterally through the insulation cap to secure the plurality of insulation blocks to the insulation cap. Element 14: further comprising a reflective coating positioned on an inner surface of the support structure. Element 15: further comprising an insulative coating positioned on at least one of an outer surface and an inner surface of the support structure.

Element 16: wherein the support structure further includes at least one of an outer wall and an inner wall, and the top wall extends between either the outer wall or the inner wall, the method further comprising at least partially supporting the one or more sidewall insulation loops with a footing provided at the bottom end and extending from one or both of the outer and inner walls. Element 17: further comprising insulating the mold with the rigid insulation material, wherein the rigid insulation material is a material selected from the group consisting of ceramics, ceramic blocks, moldable ceramics, cast ceramics, fire bricks, refractory bricks, graphite blocks, shaped graphite blocks, metal foams, metal castings, any composite thereof, and any combination thereof. Element 18: wherein at least one of the one or more sidewall insulation loops comprises a plurality of insulation blocks that cooperatively extend along the circumference of the insulation enclosure, the method further comprising filling one or more gaps defined between adjacent insulation blocks of the plurality of insulation blocks with a thermal-shock-resistant filler. Element 19: wherein one or more support rods extend through the one or more sidewall insulation loops, the method further comprising supporting the one or more sidewall insulation loops with the top wall via the one or more support rods. Element 20: wherein the rigid insulation material extending across the top end is an insulation cap supported by the top wall and comprises at least one of a monolithic disc and a plurality of insulation blocks. Element 21: wherein lowering the insulation enclosure around the mold is preceded by preheating the insulation enclosure. Element 22: further comprising drawing thermal energy from the bottom of the mold with the thermal heat sink.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method, comprising:

removing a mold from a furnace, the mold having a top and a bottom;

placing the mold on a thermal heat sink with the bottom adjacent the thermal heat sink;

lowering an insulation enclosure around the mold, the insulation enclosure including a support structure having a top end, a top wall provided at the top end, and a bottom end defining an opening for receiving the mold within an interior of the support structure, the insulation enclosure further including rigid insulation material supported by the support structure and extending between the top and bottom ends and positioned atop the top wall, the rigid insulation material including one or more sidewall insulation loops that extend along a circumference of the support structure, wherein at least one of the sidewall insulation loops comprises a plurality of insulation blocks arranged end to end;

filling a gap defined between adjacent insulation blocks of the plurality of insulation blocks with a thermal-shock-resistant filler; and cooling the mold axially upward from the bottom to the top.

2. The method of claim 1, wherein the support structure further includes at least one of an outer wall and an inner wall, and the top wall extends between either the outer wall or the inner wall, the method further comprising at least partially supporting the one or more sidewall insulation loops with a footing provided at the bottom end and extending from one or both of the outer and inner walls.

3. The method of claim 1, further comprising insulating the mold with the rigid insulation material, wherein the rigid insulation material is a material selected from the group consisting of ceramic, a ceramic block, moldable ceramic, cast ceramic, fire brick, a refractory brick, a graphite block, a shaped graphite block, a metal foam, a metal casting, any composite thereof, and any combination thereof.

4. The method of claim 1, wherein one or more support rods extend through the one or more sidewall insulation loops, the method further comprising supporting the one or more sidewall insulation loops with the top wall via the one or more support rods.

5. The method of claim 1, wherein the rigid insulation material extending across the top end is an insulation cap supported by the top wall and comprises a monolithic disc.

6. The method of claim 1, wherein lowering the insulation enclosure around the mold is preceded by preheating the insulation enclosure.

7. The method of claim 1, further comprising drawing thermal energy from the bottom of the mold with the thermal heat sink.

8. An insulation enclosure, comprising:

a support structure having a top end, a top wall provided at the top end, and a bottom end defining an opening for receiving a mold within an interior of the support structure; and rigid insulation material supported by the support structure and extending between the top and bottom ends and positioned atop the top wall, the rigid insulation material including one or more sidewall insulation loops that extend along a circumference of the support structure, wherein at least one of the sidewall insulation loops comprises a plurality of insulation blocks arranged end to end, and wherein a gap defined between adjacent insulation blocks of the plurality of insulation blocks is filled with a thermal-shock-resistant filler.

9. The insulation enclosure of claim 8, wherein the support structure further includes at least one of an outer wall and an inner wall, and the top wall extends between either the outer wall or the inner wall.

10. The insulation enclosure of claim 9, wherein a cavity is defined between the outer and inner walls and the one or more sidewall insulation loops are positioned within the cavity.

11. The insulation enclosure of claim 9, wherein the support structure further provides a footing at the bottom end that extends from one or both of the outer and inner walls, and wherein the one or more sidewall insulation loops are at least partially supported by the footing.

12. The insulation enclosure of claim 8, wherein the rigid insulation material is a material selected from the group consisting of ceramic, ceramic block, moldable ceramic, cast ceramic, fire brick, refractory brick, graphite blocks, shaped graphite blocks, a metal foam, a metal casting, any composite thereof, and any combination thereof.

13. The insulation enclosure of claim 8, further comprising one or more support rods that extend through the one or more sidewall insulation loops, wherein the one or more sidewall insulation loops are supported by the top wall via the one or more support rods.

14. The insulation enclosure of claim 13, wherein the one or more support rods further extend through at least one of the top wall and the rigid insulation material positioned atop the top wall.

15. The insulation enclosure of claim 8, wherein the rigid insulation material positioned atop the top wall is an insulation cap comprising a monolithic disc supported by the top wall.

16. The insulation enclosure of claim 8, wherein the rigid insulation material positioned atop the top wall is an insulation cap comprising the plurality of insulation blocks, wherein the plurality of insulation blocks are supported by the top wall.

17. The insulation enclosure of claim 16, further comprising one or more support hangers extending from an inner surface of the top wall to secure the plurality of insulation blocks to the insulation cap.

18. The insulation enclosure of claim 16, further comprising one or more support pins extending laterally through the insulation cap to secure the plurality of insulation blocks to the insulation cap.

19. The insulation enclosure of claim 8, wherein the support structure comprises an inner surface and a reflective coating is positioned on the inner surface of the support structure.

20. The insulation enclosure of claim 8, wherein the support structure comprises an inner surface and an outer surface and an insulative coating is positioned on at least one of the outer surface and the inner surface of the support structure.

21. The insulation enclosure of claim 8, wherein the one or more sidewall insulation loops comprise a plurality of vertically-stacked sidewall insulation loops between the top and bottom ends.

22. The insulation enclosure of claim 8, wherein at least one of the one or more sidewall insulation loops comprises a continuous, monolithic ring of rigid insulation material having a cross-sectional shape of the support structure.

* * * * *